US011371781B2

(12) United States Patent
Christensen et al.

(10) Patent No.: US 11,371,781 B2
(45) Date of Patent: Jun. 28, 2022

(54) PLATE PACKAGE USING A HEAT EXCHANGER PLATE WITH INTEGRATED DRAINING CHANNEL AND A HEAT EXCHANGER INCLUDING SUCH PLATE PACKAGE

(71) Applicant: ALFA LAVAL CORPORATE AB, Lund (SE)

(72) Inventors: Rolf Christensen, Veberöd (SE); Anders Skoglösa, Ramlösa (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 16/474,385

(22) PCT Filed: Feb. 15, 2018

(86) PCT No.: PCT/EP2018/053752
§ 371 (c)(1),
(2) Date: Jun. 27, 2019

(87) PCT Pub. No.: WO2018/162201
PCT Pub. Date: Sep. 13, 2018

(65) Prior Publication Data

US 2019/0339016 A1 Nov. 7, 2019

(30) Foreign Application Priority Data

Mar. 10, 2017 (EP) ..... 17160261

(51) Int. Cl.
*F28F 3/08* (2006.01)
*F28F 3/10* (2006.01)
(Continued)

(52) U.S. Cl.
CPC ..... *F28D 9/0006* (2013.01); *F28D 9/0037* (2013.01); *F28D 9/0043* (2013.01);
(Continued)

(58) Field of Classification Search
CPC .... F28F 3/08; F28F 3/083; F28F 3/086; F28F 3/10; F28F 3/046; F28F 2265/10;
(Continued)

(56) References Cited

U.S. PATENT DOCUMENTS 6,530,425 B2 * 3/2003 Wehrmann ..... F28D 9/005 165/166
7,472,563 B2 1/2009 Knoll et al.
(Continued)

FOREIGN PATENT DOCUMENTS

CN 1127548 A 7/1996
CN 1204393 A 1/1999
(Continued)

OTHER PUBLICATIONS

English translation of the Japanese Office Action, dated Aug. 3, 2020, for Japanese Application No. 2019-565063.
(Continued)

*Primary Examiner* — Frantz F Jules
*Assistant Examiner* — Jason N Thompson
(74) *Attorney, Agent, or Firm* — Birch, Stewart, Kolasch & Birch, LLP

(57) ABSTRACT

A plate package for a heat exchanger device includes a plurality of heat exchanger plates of a first type and a plurality of heat exchanger plates of a second type. At least the heat exchanger plates of the first type include, along at least a section of the opposing side portions, a draining channel flange. The draining channel flanges are oriented in one and the same direction such that a draining channel flange of a first heat exchanger plate of the first type abuts or overlaps a draining channel flange of a subsequent heat exchanger plate. The draining channel flanges form outer walls to the outer draining portions thereby transforming the outer draining portions into draining channels. A method of
(Continued)

using such plate package in a heat exchanger device and also a heat exchanger device as such are also disclosed.

20 Claims, 6 Drawing Sheets

(51) Int. Cl.
*F28D 9/00* (2006.01)
*F28D 9/02* (2006.01)
*F28D 21/00* (2006.01)
*F28F 3/04* (2006.01)

(52) U.S. Cl.
CPC .. *F28D 21/0017* (2013.01); *F28D 2021/0064* (2013.01); *F28F 3/046* (2013.01); *F28F 2280/00* (2013.01)

(58) Field of Classification Search
CPC .. F28F 9/22; F28F 2009/222; F28F 2009/224; F28F 2225/02; F28F 2225/04; F28D 9/0006; F28D 9/0012; F28D 9/0031; F28D 9/0043; F28D 2021/0064; F28D 9/0037; F28D 9/0056; F28D 9/0018; F28D 9/0025; F28D 9/02; F25B 2339/0241; F25B 39/022; F25B 39/024
USPC ..... 165/157, 166
See application file for complete search history.

(56) References Cited

U.S. PATENT DOCUMENTS

| | | | | |
|---|---|---|---|---|
| 7,594,538 | B2 | 9/2009 | Stenhede et al. | |
| 2003/0000688 | A1* | 1/2003 | Mathur | F28F 9/005 165/167 |
| 2005/0039486 | A1* | 2/2005 | Knoll | F28D 21/0017 62/512 |
| 2006/0191672 | A1* | 8/2006 | Stenhede | F28D 9/0006 165/145 |
| 2013/0277028 | A1 | 10/2013 | Heiniö et al. | |
| 2014/0216700 | A1* | 8/2014 | Odillard | F28D 9/00 165/166 |
| 2014/0246185 | A1* | 9/2014 | Onetti | F28F 3/08 165/166 |
| 2015/0164272 | A1 | 6/2015 | Holzapfel | |
| 2015/0308295 | A1* | 10/2015 | Gaiser | F01K 23/10 60/320 |
| 2018/0112935 | A1* | 4/2018 | Seo | F28F 3/10 |
| 2019/0154349 | A1* | 5/2019 | Jensen | F28D 9/0006 |

FOREIGN PATENT DOCUMENTS

| | | | | |
|---|---|---|---|---|
| CN | 1842689 | A | 10/2006 | |
| EP | 3026386 | A1 | 6/2016 | |
| EP | 1479985 | B1 | 6/2017 | |
| JP | 61-86590 | A | 5/1986 | |
| JP | 2000-506592 | A | 5/2000 | |
| JP | 2001-248996 | A | 9/2001 | |
| JP | 2001-280889 | A | 10/2001 | |
| JP | 2005-515390 | A | 5/2005 | |
| JP | 2006-527835 | A | 12/2006 | |
| JP | 2016-148491 | A | 8/2016 | |
| WO | WO 95/00810 | A1 | 1/1995 | |
| WO | WO 97/15797 | A1 | 5/1997 | |
| WO | WO 97/45689 | A1 | 12/1997 | |
| WO | WO 03/060411 | A1 | 7/2003 | |
| WO | WO 2004/111564 | A1 | 12/2004 | |
| WO | WO 2010/103190 | A2 | 9/2010 | |
| WO | WO 2010/103190 | A3 | 12/2010 | |
| WO | WO 2010/103190 | A4 | 2/2011 | |
| WO | WO 2013/144251 | A1 | 10/2013 | |
| WO | WO-2017039346 | A1 * | 3/2017 | F28F 3/08 |
| WO | WO-2017135730 | A1 * | 8/2017 | F24H 1/40 |

OTHER PUBLICATIONS

English translations of the Chinese Office Action and Search Report, dated Jun. 19, 2020, for Chinese Application No. 201880017024.4.
International Search Report, issued in PCT/EP2018/053752, dated May 30, 2018.
Written Opinion of the International Searching Authority, issued in PCT/EP2018/053752, dated May 30, 2018.
English translation of the Korean Office Action, dated Sep. 28, 2020, for Korean Application No. 10-2019-7029217.

* cited by examiner

PLATE PACKAGE USING A HEAT EXCHANGER PLATE WITH INTEGRATED DRAINING CHANNEL AND A HEAT EXCHANGER INCLUDING SUCH PLATE PACKAGE

FIELD OF INVENTION

The invention refers to a plate package to be used in a heat exchanger device, the use of a plate package of such type in a heat exchanger device and also a heat exchanger device using such plate package.

TECHNICAL BACKGROUND

Heat exchanger devices are well known for evaporating various types of cooling medium such as ammonia, in applications for generating e.g. cold. The evaporated medium is conveyed from the heat exchanger device to a compressor and the compressed gaseous medium is thereafter condensed in a condenser. Thereafter the medium is permitted to expand and is recirculated to the heat exchanger device. One example of such device is a heat exchanger of the plate-and-shell type.

One example of a heat exchanger of the plate-and-shell type is known from WO2004/111564 which discloses a plate package composed of substantially half-circular heat exchanger plates. The use of half-circular heat exchanger plates is advantageous since it provides a large volume inside the shell in the area above the plate package, which volume improves separation of liquid and gas. The separated liquid is transferred from the upper part of the inner space to a collection space in the lower part of the inner space via an interspace between the inner wall of the shell and the outer wall of the plate package. The interspace is part of a thermo-syphon loop which sucks the liquid towards the collection space of the shell.

One problem is however that heat is transferred to the interspace both from the inner wall of the shell and from the plate package. That heat may in some cases cause the separated liquid that is fed there through to evaporate inside the interspace. Should that happen, it will have a negative impact on the thermo-syphon loop, and even from time to time stop the same.

The shell is typically made of carbon steel, whereas the heat exchanger plates making up the plate package typically are made of stainless steel. Further, the medium comprises a small amount of compressor oil which is introduced as lubricant for the compressor. However, even though the system comprises a separator, there is an inevitable remaining amount of compressor oil that cannot be successfully separated. Although the remaining amount of compressor oil can be measured in parts per million (ppm) it has a strong impact on the overall efficiency of the plate package and hence the heat exchanger device.

Experience has shown that the compressor oil has different affinity to carbon steel than to stainless steel, whereby the compressor oil has a tendency to follow the inner wall of the shell. However, a portion of the compressor oil will still come in contact with the heat exchanger plates and form deposits on their major surfaces due to the compressor oil having different temperature related properties than the medium. The deposits will act as an insulating layer across the major surfaces of the heat exchanger plates and hence on their heat transferring surfaces. Measurements show that amounts in the range of 2-5 ppm over time can lower the efficiency of the heat exchanger device as much as 20-50 percent.

The lowered efficiency is typically compensated for by making the plate package larger. This can be done by increasing the footprint of the plate package, i.e. by increasing the surface area of the individual heat exchanger plates. Another known measure is to add more heat exchanger plates to the plate package to thereby increase the available contact area between the medium and the fluid. Both these measures require a substantially larger overall material consumption, which adds weight and volume to the plate package and the shell and hence adds to the overall cost. Accordingly, as a result thereof, the plate packages and shells available on the market are often oversized in order to allow a compensation for problems caused by inevitable residues of compressor oils.

There is accordingly a need for a solution that restricts heat transfer from the shell and the plate package into the liquid transporting interspace, thereby preventing or reducing evaporation of the liquid flow. There is also a need for a solution directed to the problem of compressor oil coming in contact with the heat exchanger plates.

SUMMARY OF INVENTION

It is an object of the invention to provide a plate package design and a design of the individual heat transfer plates that restricts heat transfer from the shell and the plate package into the liquid transporting interspace that is formed there between.

Another object of the invention is to provide a plate package design and a design of the individual heat transfer plates that reduces the amount of compressor oil coming in contact with the heat transferring surfaces of the heat exchanger plates.

Another object is to allow provision of smaller, lighter and hence cheaper plate packages with remained overall efficiency of the heat exchanger device.

These objects have been achieved by a plate package for a heat exchanger device, wherein the plate package includes a plurality of heat exchanger plates of a first type and a plurality of heat exchanger plates of a second type arranged alternatingly in the plate package one on top of the other, wherein each heat exchanger plate has a geometrical main extension plane, wherein the alternatingly arranged heat exchanger plates form first plate interspaces which are substantially open and arranged to permit a flow of a medium to be evaporated there through, and second plate interspaces, which are closed and arranged to permit a flow of a fluid for evaporating the medium, wherein each of the heat exchanger plates of the first type and of the second type has a circumferential edge portion having an upper portion, a lower portion and two opposing side portions interconnecting the upper and lower portions, wherein the heat exchanger plates of the first type and of the second type further comprise, along at least a section of the opposing side portions, mating abutment portions extending along and at a distance from the circumferential edge portion, thereby separating the respective first plate interspaces into an inner heat transferring portion and two outer draining portions, wherein at least the heat exchanger plates of the first type further comprise, along at least a section of the opposing side portions, a draining channel flange extending from the circumferential edge portion in direction from the geometrical main extension plane, and wherein the draining channel flanges of the respective heat exchanger plates are oriented in one and the same direction, and have an extension with a component along a normal to the geometrical main extension plane such that a draining channel flange of a first heat exchanger plate of the first type abuts or overlaps a draining channel flange of a subsequent heat exchanger plate, said subsequent heat exchanger plate being either a heat exchanger plate of the first type or a heat exchanger plate of the second type, whereby the draining channel flanges form outer walls to the outer draining portions thereby transforming the outer draining portions into draining channels.

Accordingly, by a plate package design of the above type, cooling medium in liquid form that is present in the upper part of the shell may be guided inside and along a plurality of draining channels that extend along opposing side portions of the inner wall of the shell but at a distance therefrom, and also at a distance from the first plate interspaces that are formed between opposing major surfaces of the heat exchanger plates. The distance is provided, depending on the design of the walls and the joints respectively defining the cross section of the draining channel, by at least the material thickness of the sheet material making up the heat exchanger plates. The distance formed can be seen as an insulation which reduces heat transfer from the inner wall of the shell and from the plate interspaces in the plate package towards the draining channel and which thereby reduces the risk of the liquid medium evaporating inside the draining channel and thereby disturbance or stopping of the thermosyphon loop. Thereby a more stable liquid flow is promoted.

Also, the draining channels prevent the compressor oil, which typically, e.g. due to its stronger affinity to carbon steel than to stainless steel, is prone to follow the curvature of the inner wall of the shell, from transferring into the first interspaces of the plate package. Rather, the inflow of compressor oil into the first plate interspaces is now restricted to the longitudinal gaps facing the upper portion of the shell and which forms openings towards the first interspaces. The amount of compressor oil in that area is normally lower.

By reducing the amount of compressor oil that may come into contact with the first plate interspaces, the risk of formation of thermally insulating deposits on the heat transferring surfaces is reduced. This allows the plate package to be made smaller in terms of foot print or in terms of the number of heat exchanger plates included in the plate package while remaining the efficiency. Thereby the overall cost may be reduced.

As yet another advantage, draining flanges will provide the heat exchanger plate with an overall improved stiffness and will also contribute to the guiding of heat exchanger plates during stacking and handling of the stack until bonding. Thereby fixtures can be made less complex.

As an alternative or a supplement to the formulation that the draining channel flange extends from the circumferential edge portion in direction from the geometrical main extension plane, the draining channel flange may extend from the circumferential edge portion at an angle $\beta$ to the normal of the geometrical main extension plane.

The mating abutment portions may be formed by ridges formed in the heat exchanger plates of the first type and in the heat exchanger plates of the second type; or by the heat exchanger plates of either the first or the second type comprising a ridge and the heat exchanger plates of the other type comprising an essentially flat surface. The mating abutments portions, no matter type, will constitute contact zones along which bonding will be formed when subjecting a stack of heat exchanger plates to heating in an oven to thereby form a bonded plate package. It is to be understood that an intermediate bonding material may be arranged between the abutments portions during the stacking. The ridges forming two mating abutment portions may have the same or different heights.

The respective draining channel, as seen in a cross section transverse its longitudinal extension, may be defined by the draining channel flange, the outer draining portion and the abutment portion of a heat exchanger plate of the first type, and by the abutment portion and the outer draining portion of an adjacent heat exchanger plate of the second type.

The respective draining channel may, as seen in a cross section transverse its longitudinal extension, have a uniform cross-sectional geometry along its longitudinal extension. Thereby no undue local flow restrictions are formed.

The abutment portions of a heat exchanger plate of the first type may sealingly abut the abutment portions of a heat exchanger plate of the second type. A sealing abutment or sealing overlap provides a substantially closed draining channel as seen in the longitudinal extension. Thereby any flow out of, or into the draining channel in any direction transverse its longitudinal direction is prevented. An overlap is advantageous since it further provides a more rigid plate package.

The draining channel flanges of a heat exchanger plate of the first type may sealingly abut or sealingly overlap the draining channel flanges of a subsequent heat exchanger plate of the first or the second type. By a sealed overlap, there is no risk of compressor oil migrating into the draining channel in the transverse direction of the draining channel by any capillary action. Further, an overlap is advantageous since it further provides a more rigid plate package.

Each draining channel may have an inlet opening facing the upper portion of the circumferential edge portion, said inlet opening having a mouth having a generally horizontal extension. The inlet of the draining channel will thereby face the upper portion of the plate package and hence the free volume of the inner space of the shell above the plate package.

Each draining channel may have an outlet opening facing the lower portion of the circumferential edge portion. The lower portion of the circumferential edge portion, and hence the lower portion of the plate package is, when the plate package is used in a heat exchanger device, typically arranged to face a collection space for the medium. Thereby, medium in the liquid phase or which is converted into liquid phase while being guided along and inside the draining channel will be guided towards and emitted into the collection space.

The lower portion of the draining channel flange may extend past a transition between the side portion and the lower portion of the circumferential edge portion. The change in flow direction has shown to be advantageous to promote release of any accumulations of compressor oil.

In one embodiment of the plate package, the upper portion of each heat exchanger plate is curved and the lower portion of each heat exchanger plate is substantially straight, and wherein a first porthole is arranged in a lower section of each heat exchanger plate and located at a distance from the lower portion of the circumferential edge portion thereby defining a first intermediate portion located between the lower substantially straight portion of the circumferential edge portion and a circumferential edge of the first porthole, the first intermediate portion including the shortest distance between a centre of the first porthole and the lower portion of the circumferential edge portion, wherein a second porthole is arranged in an upper section of the heat exchanger plate and located at a distance from the upper portion of the circumferential edge portion thereby defining a second intermediate portion located between the upper portion of the circumferential edge portion and a circumferential edge of the second porthole, the second intermediate portion including the shortest distance between a centre of the second porthole and the upper portion of the circumferential edge portion, wherein a first shielding flange is arranged along at least a section of the first intermediate portion and having an extension along the lower portion of the circumferential edge portion, and said first shielding flange having a length as seen in a direction transverse the shortest distance, being smaller than the diameter of the first porthole and more preferred smaller than 80% of the diameter of the first porthole, and/or wherein a second shielding flange is arranged along at least a section of the second intermediate portion and having an extension along the upper portion of the circumferential edge portion and said second shielding flange having a length as seen in a direction transverse the shortest distance, being 200-80% of the diameter of the second porthole and more preferred 180-120% of the diameter of the second porthole.

When subjecting the heat exchanger plate to heat during bonding of a stack of heat exchanger plates in an oven, the heat will transfer from the periphery of the heat exchanger plate towards the centre thereof. The time to achieve an even temperature gradient across the heat exchanger plate will depend on the amount of material that must be heated. In a prior art heat exchanger plate the intermediate portion will be heated faster than the remainder of the heat exchanger plate. Such uneven temperature gradient in combination with the fact that the intermediate portion may be weaker than the remainder of the heat exchanger plate results in the risk of a thermal buckling of the intermediate portion. The buckling jeopardizes the intended contact surfaces between adjacent heat exchanger plates, which in turn may result in insufficient bonding and leaking joints. In the worst case scenario, the resulting plate package will leak fluid to the medium, which is a non-acceptable defect.

By arranging shielding flanges along at least an extension of the intermediate portions in the proximity to the portholes, a heat shielding effect is provided for. The heat shielding effect is caused by the locally added material that must be heated prior to the intermediate portion. By providing the locally added material as a shielding flange, the added material will not form part of the available heat transferring area/foot print of the heat exchanger plate but rather extend along the circumferential side walls of the plate package. Accordingly, a more even temperature gradient may be provided. The improved heat distribution allows for an overall higher joint quality and thereby a lower risk of leakage.

The shielding flanges will not only act as a heat shield, but also provide the heat exchanger plate with an overall improved stiffness that makes the heat exchanger plate less flabby during handling. The latter is especially the case for larger heat exchanger plates. Further, the shielding flanges will contribute to the guiding of heat exchanger plates during stacking and handling of the stack until bonding. Thereby fixtures can be made less complex.

The extensions of the shielding flanges depend on parameters such as the curvature of the portion of the circumferential edge portions along which the respective portholes are arranged, the shortest distances between the center of the portholes and the circumferential edges, the diameters of the portholes and the thickness of the material of the heat exchanger plate.

The substantially straight lower edge portion makes the area of the first intermediate portion larger than the area of the second intermediate portion which is arranged adjacent the curved upper portion. Provided the respective shortest distances of the first and second intermediate portions are the same and also the diameters of the first and second portholes, the area of the second intermediate portion will be smaller than the area of the first intermediate portion. To allow a corresponding heat shielding effect, the second shielding flange should thus be made longer than the first shielding flange.

Simulations and trials have shown that provided the lower edge portion is essentially straight, the first shielding flange may have a length that as seen in a direction transverse the shortest distance between the lower portion of the circumferential edge portion and the centre of the first porthole is smaller than the diameter of the first porthole and more preferred smaller than 80% of the diameter of the first porthole. Likewise, the second shielding flange may have a length of 200-80% of the diameter of the second porthole and more preferred 180-120% of the diameter of the second porthole.

According to another aspect, the invention refers to the use of the plate package as described above in a heat exchanger device. The plate package is especially suitable to be used in a heat exchanger of the plate-and-shell type. The advantages of such use have been discussed in the paragraphs above, and to avoid undue repetition, reference is made to the paragraphs above.

According to yet another aspect, the invention refers to a heat exchanger device including a shell which forms a substantially closed inner space and which includes an inner wall surface facing the inner space, said heat exchanger device being arranged to include a plate package, said plate package including a plurality of heat exchanger plates of a first type and a plurality of heat exchanger plates of a second type arranged alternatingly in the plate package one on top of the other, wherein each heat exchanger plate has a geometrical main extension plane and is provided in such a way that the main extension plane is substantially vertical, wherein the alternatingly arranged heat exchanger plates form first plate interspaces which are substantially open towards the inner space and arranged to permit circulation of a medium to be evaporated from a lower part of the inner space upwardly to an upper part of the inner space, and second plate interspaces, which are closed to the inner space and arranged to permit flow of a fluid for evaporating the medium, wherein each of the heat exchanger plates of the first type and of the second type has a circumferential edge portion having an upper portion, a lower portion and two opposing side portions interconnecting the upper and lower portions, wherein the heat exchanger plates of the first type and of the second type further comprise, along at least a section of the opposing side portions, mating abutment portions extending along and at a distance from the circumferential edge portion, thereby separating the respective first plate interspaces into an inner heat transferring portion and two outer draining portions, wherein at least the heat exchanger plates of the first type further comprise, along at least a section of the opposing side portions, a draining channel flange extending from the circumferential edge portion in direction from the geometrical main extension plane, and wherein the draining channel flanges of the respective heat exchanger plates are oriented in one and the same direction, and have an extension with a component along a normal to the main extension plane such that a draining flange of a first heat exchanger plate of the first type abuts or overlaps a draining channel flange of a subsequent heat exchanger plate, said subsequent heat exchanger plate being either a heat exchanger plate of the first type or a heat exchanger plate of the second type, whereby the draining channel flanges form outer walls to the outer draining portions thereby transforming the outer draining portions into draining channels.

The advantages of a heat exchanger device with this combination of features has been thoroughly discussed above in the context of a heat exchanger plate and a plate package including such plate. To avoid undue repetition, reference is made to the paragraphs given above.

Preferred embodiments appear in the dependent claims and in the description.

BRIEF DESCRIPTION OF THE DRAWINGS

The invention will by way of example be described in more detail with reference to the appended schematic drawings, which show a presently preferred embodiment of the invention.

DETAILED DESCRIPTION OF PREFERRED EMBODIMENTS

Figure 1:
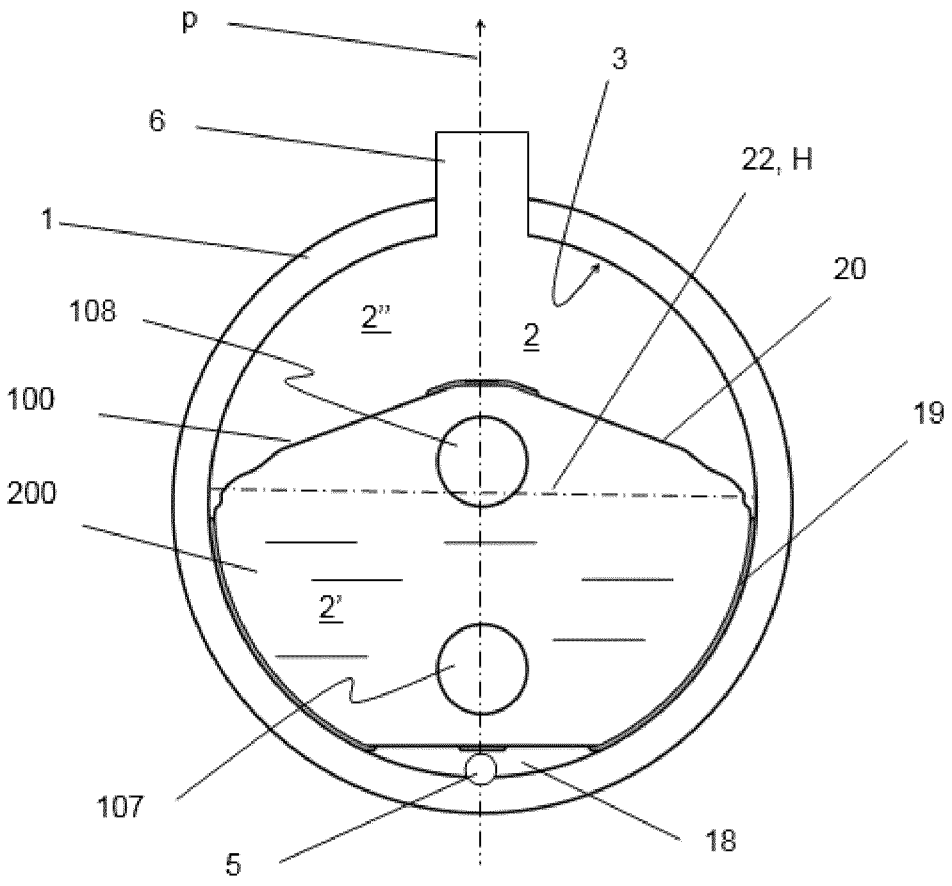
FIG. 1 discloses a schematically and sectional view from the side of a heat exchanger device of the plate-and-shell type.
Figure 2:
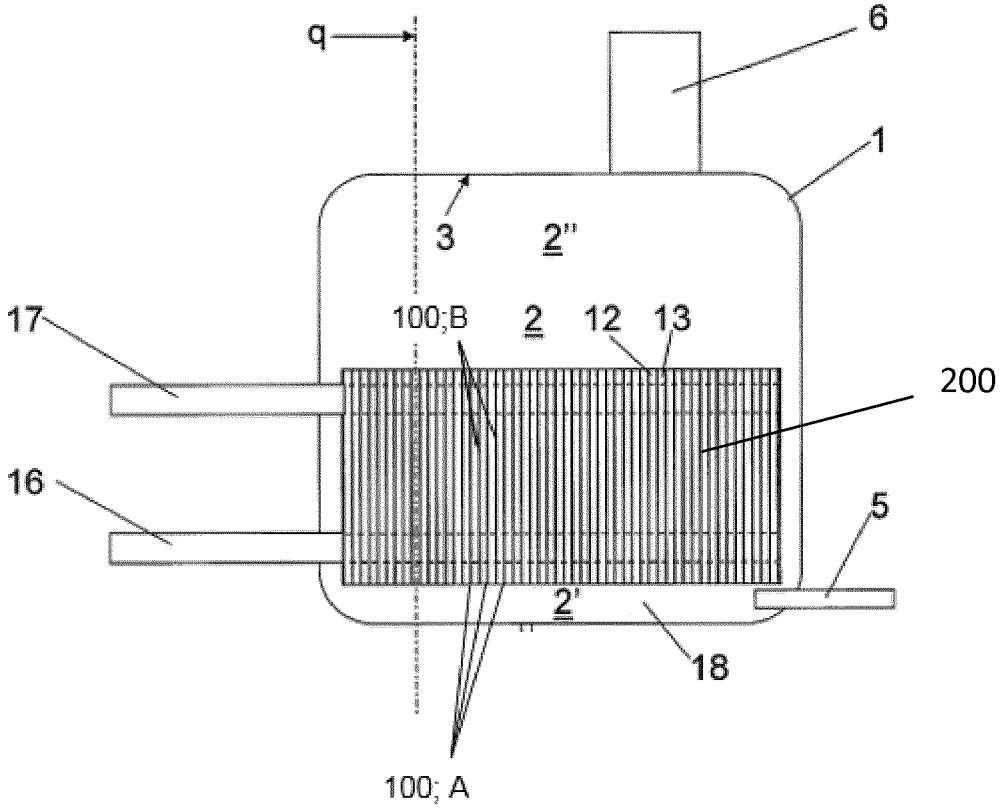
FIG. 2 discloses schematically another sectional view of the heat exchanger device of FIG. 1.

Referring to FIGS. 1 and 2, a schematic cross section of a typical heat exchanger device of the plate-and-shell type is disclosed. The heat exchanger device includes a shell 1, which forms a substantially closed inner space 2. In the embodiment disclosed, the shell 1 has a substantially cylindrical shape with a substantially cylindrical shell wall 3, see FIG. 1, and two substantially plane end walls (as shown in FIG. 2). The end walls may also have a semi-spherical shape, for instance. Also other shapes of the shell 1 are possible. The shell 1 comprises a cylindrical inner wall surface 3 facing the inner space 2. A sectional plane p extends through the shell 1 and the inner space 2. The shell 1 is arranged to be provided in such a way that the sectional plane p is substantially vertical. The shell 1 may by way of example be of carbon steel.

The shell 1 includes an inlet 5 for the supply of a two-phase medium in a liquid state to the inner space 2, and an outlet 6 for the discharge of the medium in a gaseous state from the inner space 2. The inlet 5 includes an inlet conduit which ends in a lower part space 2' of the inner space 2. The outlet 6 includes an outlet conduit, which extends from an upper part space 2" of the inner space 2. In applications for generation of cold, the medium may by way of example be ammonia.

The heat exchanger device includes a plate package 200, which is provided in the inner space 2 and includes a plurality of heat exchanger plates 100 provided adjacent to each other. The heat exchanger plates 100, are discussed in more detail in the following with reference in FIG. 3. The heat exchanger plates 100 are permanently connected to each other in the plate package 200, for instance through welding, brazing such as copper brazing, fusion bonding, or gluing. Welding, brazing and gluing are well-known techniques and fusion bonding can be performed as described in WO 2013/144251 A1. The heat exchanger plates 100 may be made of a metallic material, such as a iron, nickel, titanium, aluminum, copper or cobalt based material, i.e. a metallic material (e.g. alloy) having iron, nickel, titanium, aluminum, copper or cobalt as the main constituent. Iron, nickel, titanium, aluminum, copper or cobalt may be the main constituent and thus be the constituent with the greatest percentage by weight. The metallic material may have a content of iron, nickel, titanium, aluminum, copper or cobalt of at least 30% by weight, such as at least 50% by weight, such as at least 70% by weight. The heat exchanger plates 100 are preferably manufactured in a corrosion resistant material, for instance stainless steel or titanium.

Each heat exchanger plate 100 has a main extension plane q and is provided in such a way in the plate package 200 and in the shell 1 that the extension plane q is substantially vertical and substantially perpendicular to the sectional plane p. The sectional plane p also extends transversally through each heat exchanger plate 100. In the embodiment disclosed, the sectional plane p also thus forms a vertical centre plane through each individual heat exchanger plate 100.

The heat exchanger plates 100 form in the plate package 200 first interspaces 12, which are open towards inner space 2, and second plate interspaces 13, which are closed towards the inner space 2. The medium mentioned above, which is supplied to the shell 1 via the inlet 5, thus pass into the plate package 200 and into the first plate interspaces 12.

Each heat exchanger plate 100 includes a first port opening 107 and a second port opening 108. The first port openings 107 form an inlet channel connected to an inlet conduit 16. The second port openings 108 form an outlet channel connected to an outlet conduit 17. It may be noted that in an alternative configuration, the first port openings 107 form an outlet channel and the second port openings 108 form an inlet channel. The sectional plane p extends through both the first port opening 107 and the second port opening 108. The heat exchanger plates 100 are connected to each other around the port openings 107 and 108 in such a way that the inlet channel and the outlet channel are closed in relation to the first plate interspaces 12 but open in relation to the second plate interspaces 13. A fluid may thus be supplied to the second plate interspaces 13 via the inlet conduit 16 and the associated inlet channel formed by the first port openings 107, and discharged from the second plate interspaces 13 via the outlet channel formed by the second port openings 108 and the outlet conduit 17.

As is shown in FIG. 1, the plate package 200 has an upper side and a lower side, and two opposite transverse sides. The plate package 200 is provided in the inner space 2 in such a way that it substantially is located in the lower part space 2' and that a collection space 18 is formed beneath the plate package 200 between the lower side of the plate package and the bottom portion of the inner wall surface 3.

Furthermore, recirculation channels 19 are formed at each side of the plate package 200. These may be formed by gaps between the inner wall surface 3 and the respective transverse side or as internal recirculation channels formed within the plate package 10.

Each heat exchanger plate 100 includes a circumferential edge portion 20 which extends around substantially the whole heat exchanger plate 100 and which permits said permanent connection of the heat exchanger plates 100 to each other. These circumferential edge portions 20 will along the transverse sides abut the inner cylindrical wall surface 3 of the shell 1. The recirculation channels 19 are formed by internal or external gaps extending along the transverse sides between each pair of heat exchanger plates 100. It is also to be noted that the heat exchanger plates 100 are connected to each other in such a way that the first plate interspaces 12 are closed along the transverse sides, i.e. towards the recirculation channels 19 of the inner space 2.

The embodiment of the heat exchanger device disclosed in this application may be used for evaporating a two-phase medium supplied in a liquid state via the inlet 5 and discharged in a gaseous state via the outlet 6. The heat necessary for the evaporation is supplied by the plate package 200, which via the inlet conduit 16 is fed with a fluid for instance water that is circulated through the second plate interspaces 13 and discharged via the outlet conduit 17. The medium, which is evaporated, is thus at least partly present in a liquid state in the inner space 2. The liquid level may extend to the level 22 indicated in FIG. 1. Consequently, substantially the whole lower part space 2' is filled by medium in a liquid state, whereas the upper part space 2" contains the medium in mainly the gaseous state.

Figure 3:
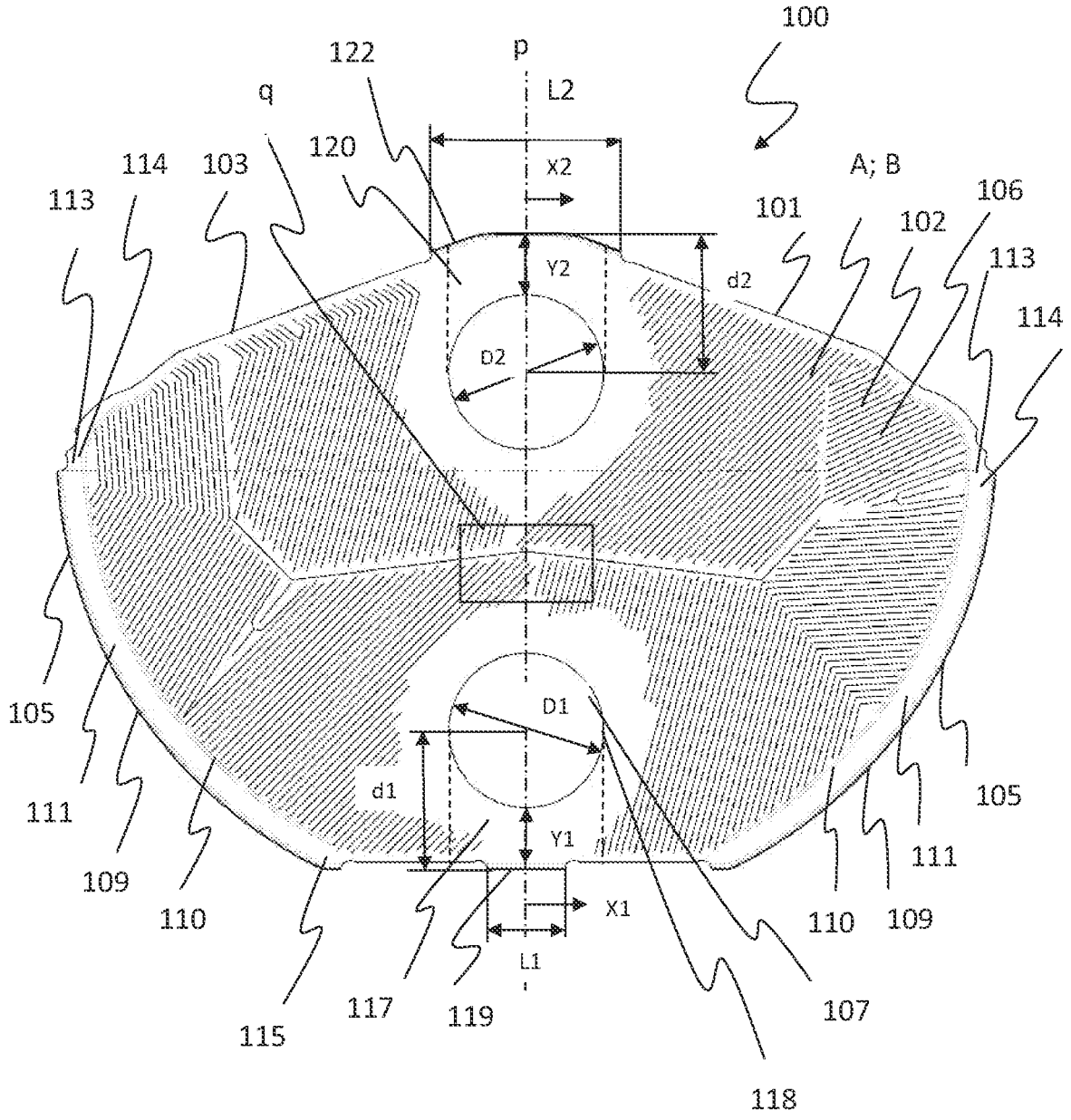
FIG. 3 discloses a heat exchanger plate.

Now turning to FIG. 3, a detailed first embodiment of the heat exchanger plate 100 is disclosed. The heat exchanger plate 100 is intended to form part of the plate package 200 according to the invention. The heat exchanger plate 100 may easily be converted into a heat exchanger plate of a first type A or a heat exchanger plate of a second type B in a manner to be described below.

The heat exchanger plate 100 is provided by a pressed thin walled sheet metal plate. The heat exchanger plate 100 may by way of example be made of stainless steel. The heat exchanger plate 100 has a geometrical main extension plane q and a circumferential edge portion 101. The circumferential edge portion 101 delimits a heat transferring surface 102 extending essentially across the geometrical main extension plane q.

The circumferential edge portion 101 comprises a curved upper portion 103, a substantially straight lower portion 104 and two opposing side portions 105 interconnecting the upper and the lower portions 103, 104. The two opposing side portions 105 do each have a curvature corresponding to the curvature of the inner wall 3 of the shell 1 of the heat exchanger device.

The heat transferring surface 102 comprises a corrugated pattern 106 of ridges and valleys. To facilitate the understanding of the invention the corrugated pattern 106 in and around the first and second portholes 107, 108 (to be discussed below) have been removed. The corrugations 106 extend in different directions at different parts of the heat exchanger plate 100. When a plurality of heat exchanger plates 100 are stacked, one on top of the other, to thereby form the plate package 200, every second heat exchanger plate 100 (heat exchanger plate of the first type A) is turned in the manner disclosed in FIG. 3, whereas every other heat exchanger plate 100 (heat exchanger of the second type B) is rotated 180 degrees about a substantially vertical rotary axes coinciding with the sectional plane p. Thereby the corrugations 106 of adjacent heat exchanger plates 100 will cross each other. Also, a plurality of contact points will be formed where the ridges of the adjacent heat exchanger plates 100 abut each other. A layer of bonding material (not disclosed) may be arranged between the heat exchanger plates 100 during stacking. As the stack later is subjected to heat in an oven, the heat exchanger plates 100 will bond to each other along the contact points and thereby form a complex pattern of fluid channels. In such a way, an efficient heat transfer from the fluid to the medium is ensured at the same time as the plates included in the plate package 200 are given the required mechanical support.

Depending on how the heat exchanger plate 100 is oriented in the plate package 200, one side of the heat exchanger plate 100 will, during operation of the plate package 200 in a heat exchanger device 300, face the first plate interspace 12 and hence be in contact with the two-phase medium, whereas the opposite side of the heat exchanger plate 100 will face the second plate interspace 13 and hence be in contact with the fluid.

The heat exchanger plate comprises a first porthole 107 intended to form an inlet port to the plate package 200 and a second porthole 108 intended to form an outlet port to the plate package 200.

In the disclosed embodiment, the first porthole 107 is located in the proximity of the lower portion 104 and the second porthole 108 is located in the proximity of the upper portion 103. When the heat exchanger plate 100 is arranged to form part of a plate package 200, the fluid will hence during operation, flow upwardly through the second plate interspaces 12 in the plate package 200. Alternatively, it is possible to provide the first portholes 107 at the upper portion 103 and the second portholes 108 at the lower portion 104. It is also possible to provide the portholes 107, 108 in other positions on the heat exchanger plate 100.

Figure 4:
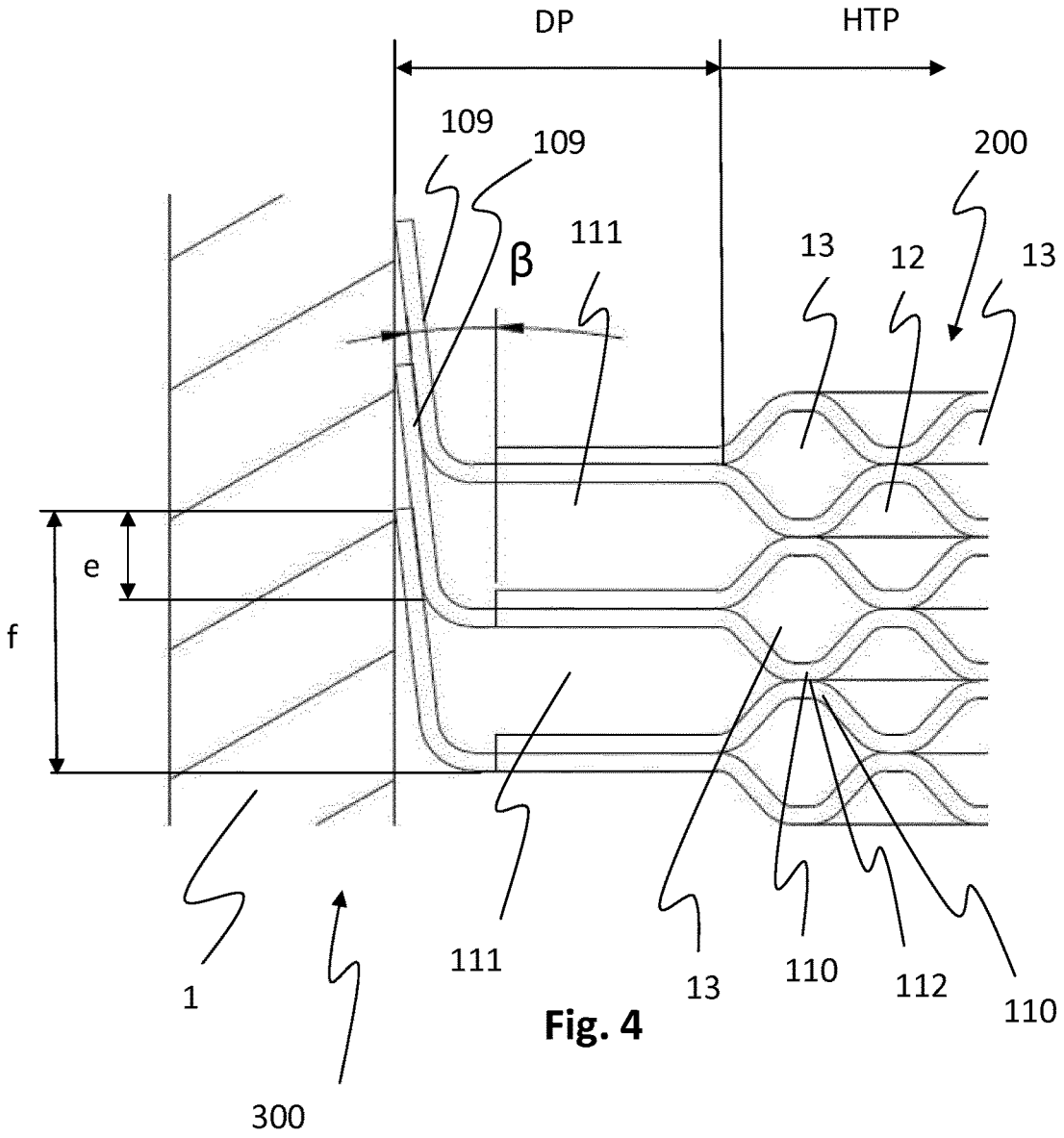
FIG. 4 discloses a cross section of a plate package comprising heat exchanger plates of the type disclosed in FIG. 3.

Now turning to FIGS. 3 and 4 the heat exchanger plate 100 comprises a draining channel flange 109 that extends along the two opposite side portions 105 of the circumferential edge portion 101. The draining channel flange 109 also has an extension that partly extends along the lower portion 104 of the circumferential edge portion 101.

The draining channel flange 109 extends from the circumferential edge portion 101 in direction from the geometrical main extension plane q. The draining channel flange 109 extends from the circumferential edge portion 101 at an angle β to the normal of the geometrical main extension plane q.

Also, the heat exchanger plate 100 comprises a ridge 110 that extends along the two opposite side portions 105 of the circumferential edge portion 101. The ridge 110 is located at a distance from the draining channel flange 109 and follows the curvature thereof. In the disclosed embodiment, the ridge 110 also has an extension that partly extends along the upper portion 103 of the circumferential edge portion 101.

Now turning specifically to FIG. 4, a cross section of a plate package 200 being arranged in the shell 1 of a heat exchanger device 300 is disclosed. A draining channel 111 is disclosed as seen transverse its longitudinal extension. In the disclosed embodiment, the draining flange 109 of every second heat exchanger plate 100 has been cut-off to thereby convert that plate into a heat exchanger plate 100 of the second type B. In all other aspects the heat exchanger plates are identical.

When two heat exchanger plates 100 of the first and second types A, B are stacked as disclosed in FIG. 4, the ridges 110 of two subsequent heat exchanger plates 100 will form mating abutment portions 112. In a bonded condition, the abutment portions 112 of a heat exchanger plate 100 of the first type A will sealingly abut the corresponding abutment portions 112 of a heat exchanger plate 100 of the second type B.

The mating abutment portions 112 extend along and at a distance from the circumferential edge portion 101, thereby separating the respective first plate interspaces 12 into an inner heat transferring portion HTP and two outer draining portions DP. When stacked, the draining channel flanges 109 of the respective heat exchanger plates 100 are oriented in one and the same direction, and have an extension with a component along a normal to the main extension plane such that a draining channel flange 109 of a first heat exchanger plate 100 of the first type abuts or overlaps a draining channel flange 109 of a subsequent heat exchanger plate. It is to be understood that the subsequent heat exchanger plate 100 may be either a heat exchanger plate 100 of the first type A or a heat exchanger plate 100 of the second type B.

The draining channel flanges 109 form outer walls to the outer draining portions DP thereby transforming the outer draining portions DP into draining channels 111. After bonding, the draining channel flanges 109 of a heat exchanger plate 100 of the first type sealingly abuts or sealingly overlaps the draining channel flanges 109 of a subsequent heat exchanger plate 100 of the first or the second type.

The draining channel 111 has a cross section as seen transverse its longitudinal extension that is defined by the draining channel flange 109, the outer draining portion DP and the abutment portion 112 of a heat exchanger plate 100 of the first type A, and by the abutment portion 112 and the outer draining portion DP of an adjacent heat exchanger plate 100 of the second type B.

The draining channel 111 preferably has, as seen in a cross section transverse its longitudinal extension, a uniform cross-sectional geometry along its longitudinal extension.

When the resulting plate package 200 is arranged in the shell 1 of a heat exchanger device 300, the respective draining channel flanges 109 may be in contact with the inner wall 3 of the shell 1.

In the disclosed embodiment, the ridges 110 are of equal height. The skilled person will understand that the ridges 110 may be of different height and also that one heat exchanger plate 100 may be provided with a ridge 110, whereas the subsequent heat exchanger plate 100 may comprise an essentially flat mating abutment portion 112.

Now turning to FIG. 3 anew, the draining channel 111 has an inlet opening 113 facing the upper portion 103 of the circumferential edge portion 101. The inlet opening 113 has a mouth 114 having a generally horizontal extension. Further, the draining channel 111 has an outlet opening 115 facing the lower portion 104 of the circumferential edge portion 101. The draining channel flange 109 extends past a transition between the side portion 105 and the lower portion 104 of the circumferential edge portion 101.

Now turning to FIG. 4, when a plate package 200 that is composed by heat exchanger plates 100 of this type is used in a heat exchanger device 300 of the plate-and-shell type, medium in liquid form that is present in the upper part space 2" of the shell 1 may be guided inside and along a plurality of draining channels 111 that extend along opposing side portions of the inner wall surface 3 of the shell 1 but at a distance therefrom, and also at a distance from the first plate interspaces 12 that are formed between opposing major surfaces of the heat exchanger plates 100. The distance is provided, depending on the design of the walls and the joints respectively defining the cross section of the draining channel 111 by at least the material thickness of the sheet material making up the heat exchanger plates 100. The distance formed can be seen as an insulation which reduces heat transfer from the inner wall surface 3 of the shell 1 and from the first plate interspaces 12 in the plate package 200 towards the draining channel 111 and which thereby reduces the risk of the liquid medium evaporating inside the draining channel 111 and thereby disturbance or stopping of the thermo-syphon loop. Thereby a more stable liquid flow is promoted.

Also, the draining channels 111 prevents the compressor oil, which typically, due to its stronger affinity to carbon steel than stainless steel, is prone to follow the curvature of the inner wall surface 3 of the shell 1, from transferring into the first interspaces 12 of the plate package 200. By the presence of the draining channels 111, the compressor oil that is present inside the interspace between the inner wall surface 3 of the shell 1 and the outer boundary of the plate package 200 is prevented from transferring in a direction transverse the longitudinal extension of the draining channel 111 and into the first plate interspaces 12. Instead, the inflow of compressor oil into the first plate interspaces 12 is now restricted to longitudinal gaps 116 facing the upper part space 2" of the shell 1 and which forms openings towards to the first interspaces 12.

Now turning to FIG. 3 anew, the first porthole 107 is arranged in a lower section of the heat exchanger plate 100 and located at a distance from the lower portion 104 of the circumferential edge portion 101. Thereby a first intermediate portion 117 is defined which is located between the circumferential edge portion 101 and a circumferential edge 118 of the first porthole 107. The first intermediate portion 117 includes the shortest distance d1 between a centre of the first porthole 107 and the lower portion 104 of the circumferential edge portion 101. Also, the first intermediate portion 117 has a height Y1 along the shortest distance d1 and a width X1 transverse to the shortest distance d1.

A first shielding flange 119 is arranged to have an extension along the lower portion 104 of the circumferential edge portion 101. The first shielding flange 119 is arranged to extend along at least a section of the first intermediate portion 117. The first shielding flange 119 extends towards the surface of the heat exchanger plate 100 that is intended to be in contact with the fluid, i.e. the surface that is intended to face the second plate interspace.

The first shielding flange 119 has a length L1 as seen in a direction transverse the shortest distance d1, being smaller than the diameter D1 of the first porthole 107 and more preferred smaller than 80% of the diameter D1 of the first porthole 107.

The second porthole 108 is arranged in an upper section of the heat exchanger plate 100 and located at a distance from the upper portion 103 of the circumferential edge portion 101. Thereby a second intermediate portion 120 is defined which is located between the circumferential edge portion 101 and a circumferential edge 121 of the second porthole 108. The second intermediate portion 120 includes the shortest distance d2 between a centre of the second porthole 108 and the upper portion 103 of the circumferential edge portion 101. Also, the second intermediate portion 120 has a height Y2 along the shortest distance d2 and a width X2 transverse to the shortest distance d2.

A second shielding flange 122 is arranged to have an extension along the upper portion 103 of the circumferential edge portion 101. The second shielding flange 122 is arranged to extend along at least a section of the second intermediate portion 120. The second shielding flange 122 extends towards the surface of the heat exchanger plate 100 that is intended to be in contact with the fluid, i.e. the surface that is intended to face the second plate interspace 13.

The second shielding flange 122 has a length L2 as seen in a direction transverse the shortest distance d2, being 200-80% of the diameter D2 of the second porthole 108 and more preferred 180-120% of the diameter D2 of the second porthole 108.

Figure 6:
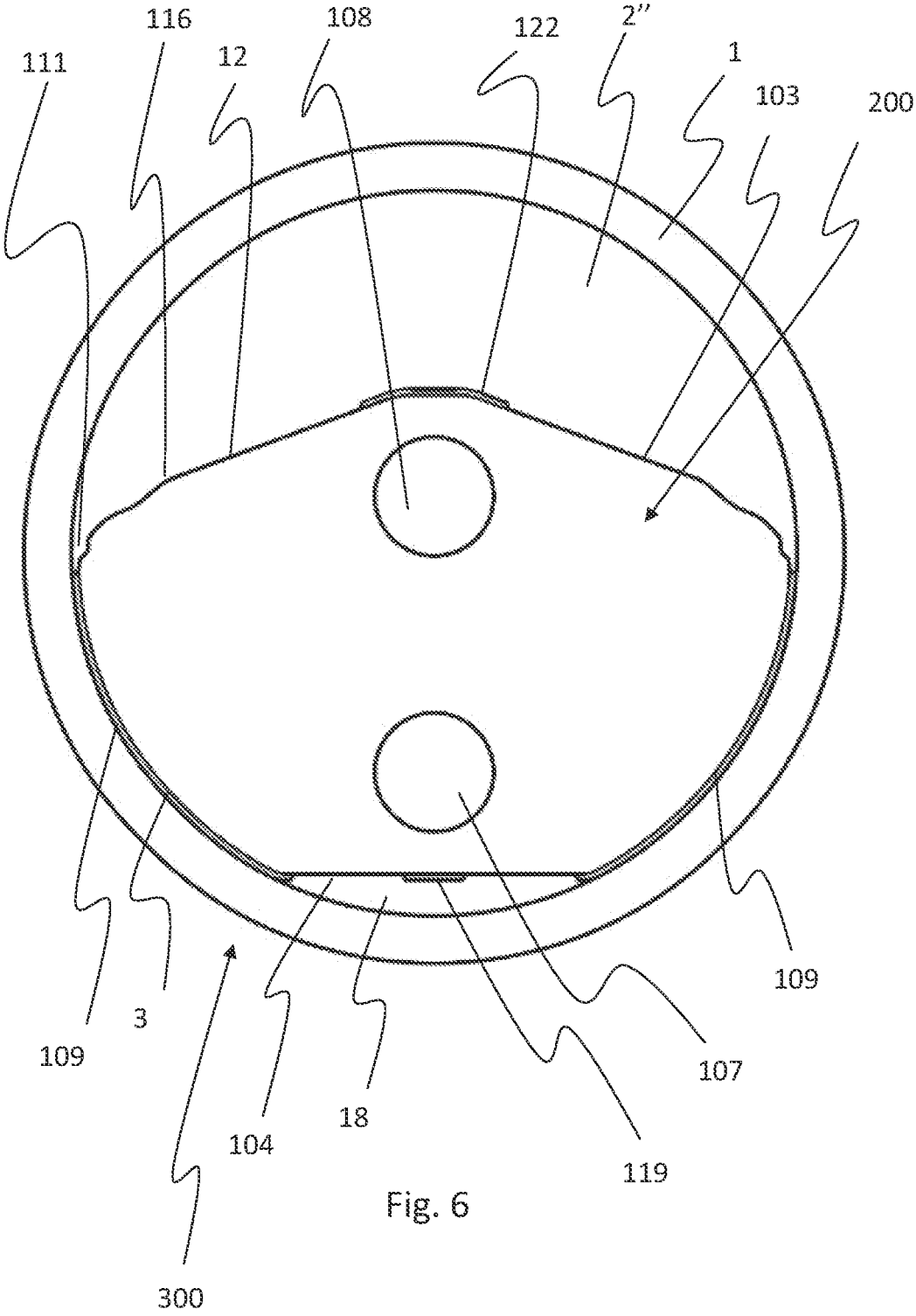
FIG. 6 discloses a schematic cross section of a heat exchanger device.

As is best seen in FIGS. 3 and 6, the curvature of the upper portion 103 of the circumferential edge portion 101 of the heat exchanger plate 100 differs from the curvature of the lower portion 104 of the heat exchanger plate 100. When the heat exchanger 100 is included in a plate package 200 and used in a heat exchanger device 300, the lower portion 104 is intended to face the collection space 18 that is formed in the shell 1 beneath the plate package 200. To allow the collection space 18 to have a certain volume, the lower portion 104 is in the disclosed embodiment more or less straight, whereas the upper portion 103 which is intended to face the upper part space 2" of the shell 1 has a convex curvature. Accordingly, the extension of the circumferential edge portion 101 adjacent a porthole 107; 108 affects the area of the available intermediate portion 117; 120.

In the case where the lower portion 104 is essentially straight, the height Y1 of the first intermediate portion 117 between the lower portion 104 and the circumferential edge 118 of the first porthole 107 will increase rather rapidly with the distance X1 from the sectional plane p. This can be compared to the second porthole 108 adjacent the curved upper portion 103 where the height Y2 of the second intermediate portion 120 between the curved upper portion 103 and the circumferential edge 121 of the second porthole 108 will increase more slowly with the distance X2 from the sectional plane p. The decisive factor in this case is the radius of the curved upper portion 103.

The impact from this difference can be seen by studying the temperature gradient when subjecting a stack of heat exchanger plates 100 to heat in an oven. The second intermediate portion 120 with the curved upper portion 103 will heat more rapidly than the first intermediate portion 117 with the straight lower portion 104. By introducing the first and the second shielding flanges 119; 122 and adjusting their lengths L1; L2 to the diameter D1; D2 of the respective porthole 107; 108, the difference in heating may be compensated for. Thereby the risk of buckling due to uneven thermal expansion and thereby insufficient bonding may be dealt with.

Figure 5:
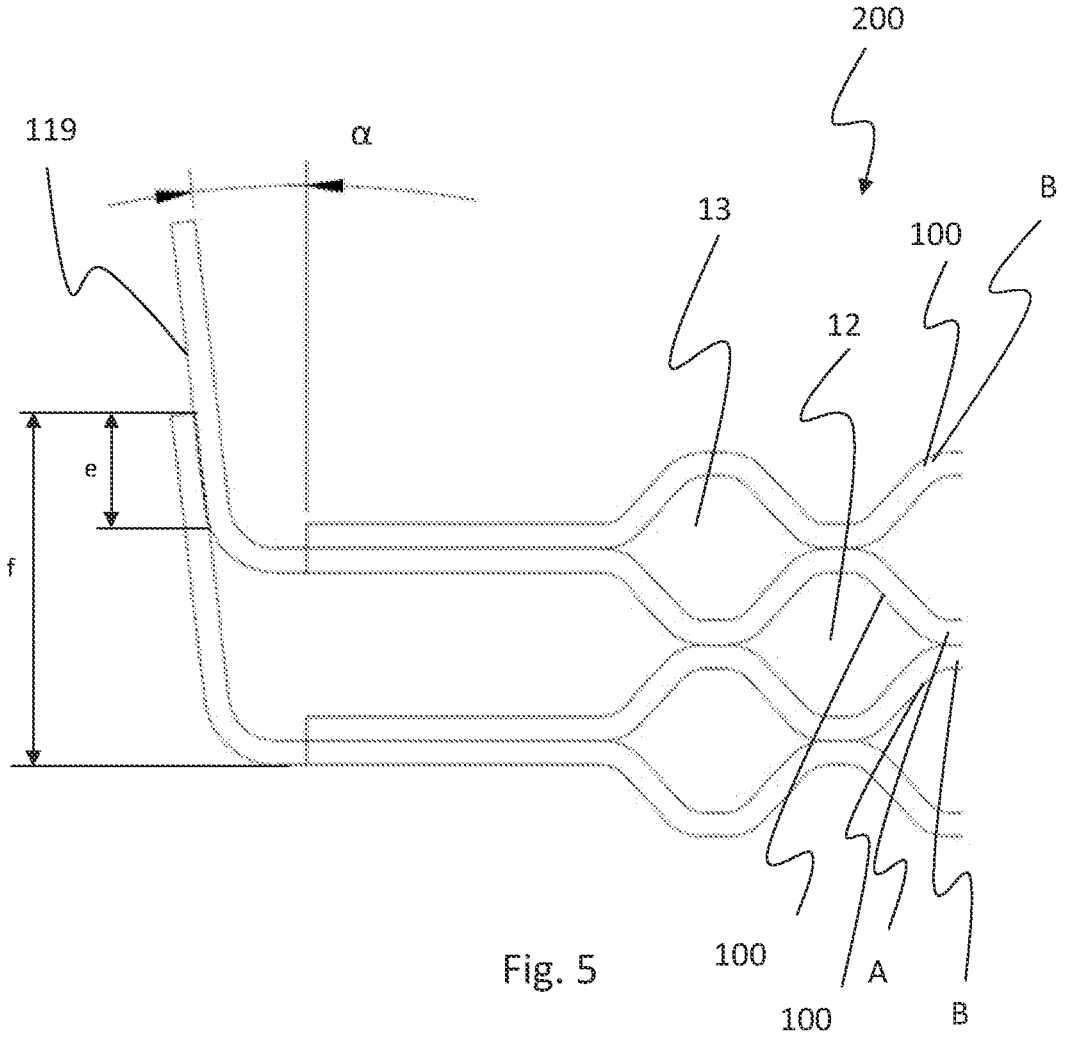
FIG. 5 discloses a cross section of the plate package as seen transverse the first shielding flange.

Now turning to FIG. 5 a schematic cross section of a plate package 200 which is composed of a plurality of heat exchanger plates 100 of the above type is disclosed. The cross section in FIG. 5 is taken transverse the first shielding flange 119. For the record, a corresponding cross section taken transverse the second shielding flange 122 may look the same.

As given above, the heat exchanger plate 100 according to the invention can easily be converted into either a heat exchanger plate 100 of a first type A or into a heat exchanger plate 100 of a second type B by simply cutting off the first and second shielding flanges 119; 122 and the draining channel flanges 109 after pressing.

When stacking the heat exchanger plates 100 to a form a plate package 200, one on top of the other, every second heat exchanger plate 100 is turned in the manner disclosed in FIG. 4, whereas every other plate is rotated 180 degrees about a substantially vertical rotary axes coinciding with the sectional plane p. Thereby the corrugated patterns 106 of adjacent heat exchanger plates 100 will cross each other. Also, a plurality of contact points will be formed where the ridges 110 of the adjacent heat exchanger plates 100 abut each other. Like in prior art, a layer of bonding material (not disclosed) may be arranged between the heat exchanger plates 100 during stacking. As the stack later is subjected to heat in an oven, the heat exchanger plates 100 will bond to each other along the contact points and thereby form a complex pattern of fluid channels. It is to be understood that the width of the joints depends of the cross section of the corrugated pattern 106.

Depending on how the heat exchanger plate 100 is oriented in the plate package 200, one side of the heat exchanger plate 100 is intended to during operation of the plate package 200 face the first plate interspace 12 intended to be in contact with the medium, whereas the other side of the heat exchanger plate 100 will face the second plate interspace 13 intended to be in contact with the fluid, such as water.

As is seen in the embodiments of FIGS. 4 and 5, the flanges 109; 119 of every second heat exchanger plate 100, i.e. the heat exchanger plate 100 of the second type B have been cut off. Also, the flanges 109; 119 of the respective heat exchanger plates 100 of the first type A are oriented in one and the same direction, and have an extension with a component along a normal to the main extension plane q such that a flange 109; 119 of a heat exchanger plate 100 of the first type A abuts or overlaps a flange 109; 119 of a second subsequent heat exchanger plate 100 of the first type A. The thus formed overlap between two subsequent flanges has a length e as seen in a direction corresponding to the normal of the geometrical main extension plane corresponding to 5-90% of the height f of the flange 109; 119.

It is to be understood that it may be sufficient if the flange 109; 119 of a heat exchanger plate 100 of the first type A abuts a flange 109; 119 of a subsequent heat exchanger plate 100.

The flanges 109; 119 are disclosed as extending from the circumferential edge portion 101 at an angle α, β to the normal of the geometrical main extension plane q. The angles α, β are preferably smaller than 20 degrees to the normal, and more preferred smaller than 15 degrees to the normal. It is to be understood that the angles α, β can be as small as 0 degrees. The angles α, β may be the same or be different from each other.

The angles α, β depend on if both of two subsequent heat exchanger plates 100 to be joined are provided with flanges 109; 119 or if only one of the heat exchanger plates 100 have a flange 109; 119. In case of only one of the heat exchanger plates 100 having a flange 109; 119, the angles α, β can be made smaller, such as smaller than 10 degrees, such as smaller than 8 degrees, and typically about 6-7 degrees.

The bonding of the heat exchanger plates 100 to provide the plate package 200 may be made by brazing or by fusion bonding as discussed above. Fusion bonding is especially suitable when the heat exchanger plates are made by stainless steel.

Now turning to FIG. 6 one embodiment of the plate package 200 according to the invention is schematically disclosed as being contained in a heat exchanger device 300 according to the invention. From this view it can clearly be seen how the first and second shielding flanges 109; 122 and also the two opposing draining channel flanges 109 form sealed circumferential side walls of the plate package 200. By the limited length of the first and second shielding flanges 119; 122, the communication between the interior of the shell 1 and the first plate interspace 12 is not restricted to any substantial degree.

It is contemplated that there are numerous modifications of the embodiments described herein, which are still within the scope of the invention as defined by the appended claims.

By way of example, the heat exchanger plates of the first and second types may be identical with the only exception that the first and second flanges and the draining channel flanges 109 on every second heat exchanger plate 100 are cut-off to thereby convert them into heat exchanger plates of the first and the second type. Thereby, one and the same press tool may be used.

It is to be understood that also the heat exchanger plates of the second type may be provided with flanges of the type described above and that these flanges are not cut-off. This allows for the flanges of heat exchanger plates of the first type to sealingly abut flanges of heat exchanger plates of the second type.

The plate package has been disclosed as being applied to a heat exchanger of the plate-and shell type. The skilled person will understand that the concept also is applicable to other types of heat exchangers.

The invention claimed is:

1. A plate package for a heat exchanger device, comprising:

a plurality of first heat exchanger plates; and a plurality of second heat exchanger plates arranged alternatingly in the plate package, one on top of another in a first direction, wherein each of the first and second heat exchanger plates have a geometrical main extension plane, and form first plate interspaces arranged to permit a flow of a medium to be evaporated there through, and second plate interspaces arranged to permit a flow of a fluid for evaporating the medium, wherein each of the first and second heat exchanger plates has a circumferential edge portion having an upper portion, a lower portion and two opposing side portions interconnecting the upper and lower portions, wherein each of the first and second heat exchanger plates further comprise, along at least a section of the opposing side portions, mating abutment portions extending along and at a distance from the circumferential edge portion, thereby separating each of the first plate interspaces into an inner heat transferring portion and two outer draining portions, wherein at least the first heat exchanger plates further comprise, along at least a section of the opposing side portions, draining channel flanges extending from the circumferential edge portion in a direction from the geometrical main extension plane, wherein the draining channel flanges of the first heat exchanger plates are oriented in a same direction, and have an extension with a component in the first direction such that the components of adjacent draining channel flanges of the first heat exchanger plates abut or overlap each other in a second direction perpendicular to the first direction, wherein the mating abutment portions form inner walls and the draining channel flanges form outer walls to the outer draining portions thereby transforming the outer draining portions into draining channels, and wherein each of the draining channels has an inlet opening between an upper end of the draining channel flange and the upper portion of the circumferential edge portion, said inlet opening having a mouth having a generally horizontal extension and an outlet opening at a lower end of the mating abutment portions facing the lower portion of the circumferential edge portion.

2. The plate package according to claim 1, wherein the mating abutment portions are formed:

by ridges formed in the first heat exchanger plates and in the second heat exchanger plates; or by one of the first or second heat exchanger plates comprising a ridge and another one of the first or second heat exchanger plates comprising an essentially flat surface.

3. The plate package according to claim 2, wherein each of the draining channels, as seen in a cross section transverse to a longitudinal extension thereof, is defined by a draining channel flange, an outer draining portion and an abutment portion of one of the first heat exchanger plates and by an abutment portion and an outer draining portion of an adjacent second heat exchanger plate.

4. The plate package according to claim 2, wherein a respective draining channel, as seen in a cross section transverse to a longitudinal extension thereof, has a uniform cross-sectional geometry along said longitudinal extension.

5. The plate package according to claim 2, wherein the abutment portions of a respective first heat exchanger plate sealingly abut the abutment portions of a respective second heat exchanger plate.

6. The plate package according to claim 1, wherein each of the draining channels, as seen in a cross section transverse to a longitudinal extension thereof, is defined by a draining channel flange, an outer draining portion and an abutment portion of one of the first heat exchanger plates and by an abutment portion and an outer draining portion of an adjacent second heat exchanger plate.

7. The plate package according to claim 6, wherein a respective draining channel, as seen in a cross section transverse to a longitudinal extension thereof, has a uniform cross-sectional geometry along said longitudinal extension.

8. The plate package according to claim 6, wherein the abutment portions of a respective first heat exchanger plate sealingly abut the abutment portions of a respective second heat exchanger plate.

9. The plate package according to claim 1, wherein a respective draining channel, as seen in a cross section transverse to a longitudinal extension thereof, has a uniform cross-sectional geometry along said longitudinal extension.

10. The plate package according to claim 9, wherein the abutment portions of a respective first heat exchanger plate sealingly abut the abutment portions of a respective second heat exchanger plate.

11. The plate package according to claim 1, wherein the abutment portions of a respective first heat exchanger plate sealingly abut the abutment portions of a respective second heat exchanger plate.

12. The plate package according to claim 1, wherein a lower portion of the draining channel flange extends past a transition between the side portion and the lower portion of the circumferential edge portion.

13. The plate package according to claim 1, wherein the upper portion of each heat exchanger plate is curved and the lower portion of each heat exchanger plate is substantially straight, and wherein a first porthole is arranged in a lower section of each heat exchanger plate and located at a distance from the lower portion of the circumferential edge portion thereby defining a first intermediate portion located between the lower substantially straight portion of the circumferential edge portion and a circumferential edge of the first porthole, the first intermediate portion including a shortest distance between a centre of the first porthole and the lower portion of the circumferential edge portion, wherein a second porthole is arranged in an upper section of the heat exchanger plate and located at a distance from the upper portion of the circumferential edge portion thereby defining a second intermediate portion located between the upper portion of the circumferential edge portion and a circumferential edge of the second porthole, the second intermediate portion including a shortest distance between a centre of the second porthole and the upper portion of the circumferential edge portion, wherein a first shielding flange is arranged along at least a section of the first intermediate portion and having an extension along the lower portion of the circumferential edge portion, and said first shielding flange having a length as seen in a direction transverse the shortest distance between a centre of the first porthole and the lower portion of the circumferential edge portion, being smaller than the diameter of the first porthole, and/or wherein a second shielding flange is arranged along at least a section of the second intermediate portion and having an extension along the upper portion of the circumferential edge portion and said second shielding flange having a length as seen in a direction transverse the shortest distance between a centre of the second porthole and the upper portion of the circumferential edge portion, being 200-80% of the diameter of the second porthole.

14. The plate package according to claim 1, wherein the upper portion of each heat exchanger plate is curved and the lower portion of each heat exchanger plate is substantially straight, and wherein a first porthole is arranged in a lower section of each heat exchanger plate and located at a distance from the lower portion of the circumferential edge portion thereby defining a first intermediate portion located between the lower substantially straight portion of the circumferential edge portion and a circumferential edge of the first porthole, the first intermediate portion including a shortest distance between a centre of the first porthole and the lower portion of the circumferential edge portion, wherein a second porthole is arranged in an upper section of the heat exchanger plate and located at a distance from the upper portion of the circumferential edge portion thereby defining a second intermediate portion located between the upper portion of the circumferential edge portion and a circumferential edge of the second porthole, the second intermediate portion including a shortest distance between a centre of the second porthole and the upper portion of the circumferential edge portion, wherein a first shielding flange is arranged along at least a section of the first intermediate portion and having an extension along the lower portion of the circumferential edge portion, and said first shielding flange having a length as seen in a direction transverse the shortest distance between a centre of the first porthole and the lower portion of the circumferential edge portion, being smaller than 80% of the diameter of the first porthole, and/or wherein a second shielding flange is arranged along at least a section of the second intermediate portion and having an extension along the upper portion of the circumferential edge portion and said second shielding flange having a length as seen in a direction transverse the shortest distance between a centre of the second porthole and the upper portion of the circumferential edge portion, being 180-120% of the diameter of the second porthole.

15. The plate package according to claim 1, wherein each abutment portion comprises at least one ridge extending along one of the side portions and along the upper portion.

16. A method comprising using the plate package according to claim 1 in a heat exchanger device.

17. A heat exchanger device, comprising:

a shell forming a substantially closed inner space and including an inner wall surface facing the inner space, said heat exchanger device being arranged to include a plate package, said plate package including:

a plurality of first heat exchanger plates and a plurality of second heat exchanger plates arranged alternatingly in the plate package, one on top of another in a first direction, wherein each of the first and second heat exchanger plates have a geometrical main extension plane and is provided in such a way that the main extension plane is substantially vertical, and form first plate interspaces which are substantially open towards the inner space and arranged to permit circulation of a medium to be evaporated from a lower part of the inner space upwardly to an upper part of the inner space, and second plate interspaces, which are closed to the inner space and arranged to permit flow of a fluid for evaporating the medium, wherein each of the first and second heat exchanger plates has a circumferential edge portion having an upper portion, a lower portion and two opposing side portions interconnecting the upper and lower portions, wherein each of the first and second heat exchanger plates further comprise, along at least a section of the opposing side portions, mating abutment portions extending along and at a distance from the circumferential edge portion, thereby separating each of the first plate interspaces into an inner heat transferring portion and two outer draining portions, wherein at least the first heat exchanger plates further comprise, along at least a section of the opposing side portions, draining channel flanges extending from the circumferential edge portion in a direction from the geometrical main extension plane, wherein the draining channel flanges of the first heat exchanger plates are oriented in a same direction, and have an extension with a component in the first direction such that the components of adjacent draining channel flanges of the first heat exchanger plates abut or overlap each other in a second direction perpendicular to the first direction, wherein the mating abutment portions form inner walls and the draining channel flanges form outer walls to the outer draining portions thereby transforming the outer draining portions into draining channels, and wherein each of the draining channels has an inlet opening between an upper end of the draining channel flange and the upper portion of the circumferential edge portion, said inlet opening having a mouth having a generally horizontal extension and an outlet opening at a lower end of the mating abutment portions facing the lower portion of the circumferential edge portion.

18. The heat exchanger device according to claim 17, wherein each abutment portion comprises at least one ridge extending along one of the side portions and along the upper portion.

19. A plate package for a heat exchanger device, comprising:

a plurality of first heat exchanger plates; and a plurality of second heat exchanger plates arranged alternatingly in the plate package, one on top of another in a first direction, wherein each of the first and second heat exchanger plates have a geometrical main extension plane, and form first plate interspaces arranged to permit a flow of a medium to be evaporated there through, and second plate interspaces arranged to permit a flow of a fluid for evaporating the medium, wherein each of the first and second heat exchanger plates has a circumferential edge portion having an upper portion, a lower portion and two opposing side portions interconnecting the upper and lower portions, wherein each of the first and second heat exchanger plates further comprise, along at least a section of the opposing side portions, mating abutment portions extending along and at a distance from the circumferential edge portion, thereby separating each of the first plate interspaces into an inner heat transferring portion and two outer draining portions, wherein both of the first heat exchanger plates and the second heat exchanger plates further comprise, along at least a section of the opposing side portions, draining channel flanges extending from the circumferential edge portion in a direction from the geometrical main extension plane, wherein the draining channel flanges of the first and second heat exchanger plates are oriented in a same direction, and have an extension with a component in the first direction such that the components of adjacent draining channel flanges abut or overlap each other in a second direction perpendicular to the first direction, wherein the draining channel flanges form outer walls to the outer draining portions thereby transforming the outer draining portions into draining channels, and wherein each of the draining channels has an inlet opening between the upper end of the draining channel flange and the upper portion of the circumferential edge portion, said inlet opening having a mouth having a generally horizontal extension and an outlet opening a lower end of the mating abutment portions facing the lower portion of the circumferential edge portion.

20. The plate package according to claim 19, wherein each abutment portion comprises at least one ridge extending along one of the side portions and along the upper portion.

* * * * *